United States Patent [19]

Meaney

[11] Patent Number: 4,782,334

[45] Date of Patent: Nov. 1, 1988

[54] VAPOR OR GAS DETECTOR AND ALARM SYSTEM

[76] Inventor: Thomas A. Meaney, 2525 Lehigh Pl., Costa Mesa, Calif. 92626

[21] Appl. No.: 85,148

[22] Filed: Aug. 13, 1987

[51] Int. Cl.[4] ..... G08B 17/10

[52] U.S. Cl. ..... 340/634; 73/23; 324/71.5

[58] Field of Search ..... 340/632, 634; 73/1 G, 73/23; 310/358, 366; 374/45; 324/71.5

[56] References Cited

U.S. PATENT DOCUMENTS

| | | | |
|---|---|---|---|
| 3,266,291 | 8/1966 | King, Jr. et al. | 73/23 |
| 3,953,844 | 4/1976 | Barr et al. | 73/28 |
| 4,138,670 | 2/1979 | Schneider et al. | 340/629 |
| 4,399,686 | 8/1983 | Kindlund et al. | 73/23 |

*Primary Examiner*—Joseph A. Orsino
*Assistant Examiner*—Jill D. Jackson
*Attorney, Agent, or Firm*—Albert O. Cota

[57] ABSTRACT

A vapor or gas detector (12) that forms an element of a vapor or gas detecting and alarm system (30). The detector in one of its embodiments is configured as a three-section dynamic junction (16) consisting of a resilient substrate (22) having a resonant mechanical element (18) attached to its back and an absorbate (20) to its front. When no toxic vapors or gases are present, the element (18) is under a no-strain, no deformation condition and emits a first frequency signal. When a toxic vapor or gas is present, the absorbate (20) absorbs the gas or vapor which causes the substrate (22) to deform and, in turn, causes the element (18) to deform and emit a second frequency signal. This second frequency signal is applied to the system (30) where the signal, through a series of electronic circuits is processed. The processed signal activates a lamp (44*a*) and an audible alarm (44*a*) indicating that the detected vapor or gas has exceeded a preselected toxicity level.

9 Claims, 2 Drawing Sheets

VAPOR OR GAS DETECTOR AND ALARM SYSTEM

TECHNICAL FIELD

The invention pertains to the general field of vapor, gas and fluid detection devices and more particularly to a vapor or gas detector that attracts and occludes molecules of gases in proportion to their molecular density, molecular size and exposure time.

BACKGROUND ART

Since there has been an awareness on the dangers of toxicity, the quick detection of toxic vapors and gases has been a goal set by both equipment users, toxicologist, and government toxic-gas monitoring agencies. These toxic vapors and gases can cause toxicosis, can reduce the quality of the environment and are dangerous to the general health and well being of mankind.

In todays industrial complex and high density vehicular traffic toxic-gas alarm episodes occur more frequently—some are detected but more often than not, they go undetected. Therefore, for the protection of personnel working in potential toxicity areas and the general public, it is necessary that a positive and quick method be available to detect and curtail these toxic gas escapes and prevent a possible catastrophic situation. The toxic detection problem is not limited to enclosed work areas, a leak in an open site, such as a petroleum tank farm or a gasoline service station, could and has led to catastrophic results.

There are several vapor and gas detection devices in use today. However, for the most part, these devices have limitations such as: excessive response time, the necessity of having to be immersed in a fluid, a narrow band of response, extreme thermal sensitivity, hot-wire thermal reaction and unsafe usage in an explosive atmosphere which is especially critical when detecting hydrocarbon emissions.

A search of the prior art did not disclose any patents that read directly on the claims of the instant invention, however, the following U.S. patents were considered related:

| U.S. PAT. NO. | INVENTOR | ISSUED |
|---|---|---|
| 3,950,739 | Campman | 13 April 1976 |
| 3,875,499 | Roberts | 1 April 1975 |
| 3,045,198 | Dolan etal | 17 July 1962 |

The Campman patent discloses an apparatus and method for detecting and locating the source of a contaminating gas in a free and unconfined atmosphere. The apparatus includes a semiconductor sensor, whose conductance varies with variations in the density of the gas in the region immediately surrounding the sensor. The sensor is connected to an electronic circuit that produces a voltage that varies with the conductance of the sensor. The voltage output is connected to a pulse generator. As the voltage varies, so does the frequency of the pulses from the pulse generator. The output of the generator, through additional circuits, is connected to visual and audible devices that produce an alarm when a contaminating gas is detected.

The Roberts patent discloses a gas detection system that uses an ionic gas detector to detect leaks in vessels, pipes and other closed systems. The detection is accomplished through the presence of certain tracer gases or vapors which pass into the surrounding atmosphere. These gases or vapors are drawn through a probe into the systems ionic gas detector. The ionic gas detector detects ions from the gas which are induced at a rate which varies with the concentration of the detected gas. The ions are collected at oppositely charged emitter and collector elements. These elements produce a current in an output circuit that is indicative of the concentration of the detected gas.

The Dolan patent discloses a detection circuit that incorporates an electrically operated adsorptive element that is sensitive to the exposure of liquids, vapors or gases. The element, which functions under Van der Walls' adsorption forces, is in a series circuit that includes a meter, a battery and current limiting resistor. Under a normal, no contaminants condition, the meter is adjusted to read zero. When the element is exposed to a contaminating substance, its resistance increases which causes the circuit resistance to also increase and show a change in the meter reading which indicates the presence of a contaminating gas. Reciprocally, when the contaminating gas decreases, the elements resistance decreases causing the circuit resistance to also decrease and return the meter to its zero reading. The element is generally comprised of a base having on its exposed surface a resilient surface with a particle stratum of discrete adsorbent metallic particles. When the element adsorbs a substance a change takes place that increases its resistance.

DISCLOSURE OF THE INVENTION

The invention consists of a vapor or gas detector that is designed to be used in combination with a vapor or gas detecting and alarm system. The system provides a visual and audio alarm to alert personnel that a preselected vapor or gas toxicity level has been exceeded.

One of the practical applications of the detector is in the monitoring of toxic gas escapes from petroleum tank farms and underground gasoline storage tanks as used in gasoline service stations. The monitoring of petroleum and gasoline storage tanks is mandated in California and in other states. Basically, the mandate requires that the tanks be checked daily for leakage and if a leak is found that the tank be repaired within 24-hours of finding the leak. The necessity for having a reliable and safe toxic gas detector/system can be gleaned by considering the magnitude of the problem: in California alone, it is estimated that there are over 65,000 gasoline service stations where each station has 3 to 4 of the tanks.

The detector is disclosed in two design configurations: a two-section dynamic junction and a three-section dynamic junction. The two-section junction consists of a resonant mechanical element, such as a crystal, having an absorbate attached directly to its front surface. The three-section junction adds a resilient substrate to which the absorbate is attached to its front surface and the crystal to its back surface. In either design, when no toxic vapor or gas is being detected, the crystal emits a first frequency signal. When a vapor or gas is present in the vicinity of the detector, it is adsorbed by the absorbate. In the case of the three-section junction, the contaminated absorbate causes the resilient substrate to deform. This deformation, in turn, causes the crystal to deform and strain at which time the crystal emits a second frequency signal indicating that a toxic vapor or gas has been detected.

The first or second frequency signal is applied to the vapor or gas detecting and alarm system. The signal is processed through a series of electronic circuits and if the processed signal exceeds an alarm level and count, as determined by pre-setting a counter circuit, a trigger signal is produced that activates the visual and audio alarms.

In view of the above description, it is the primary object of the invention to have a vapor or gas detector that reliably and accurately emits a frequency signal when a preselected toxic vapor or gas is detected.

A secondary object of the invention is to have a vapor or gas detector that can easily and compatibly be used in combination with a vapor or gas detecting and alarm system that alerts personnel when a toxic episode is in process.

In addition to the primary and secondary objects, it is also an object of the invention to have a detector that:

can be installed in a permanent installation or in a portable enclosure that can be carried by individuals, is designed to allow a specific vapor or gas or a combination of vapors and gases to be detected, can be adapted to any electronics alarm system that will accept and process a first frequency signal and a second frequency signal where the second signal is indicative of a toxic episode, because of its inherent temperature stabilization can be used either above ground or below ground, is fail safe, and is reliable in terms of a high Mean-Time-Between-Failure (MTBF).

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention includes a first and second embodiment of a vapor or gas detector 12, and the detector's application in a vapor or gas detecting and alarm system 30. The vapor or gas detector has the means to produce a first frequency signal or a second frequency signal. The first signal is emitted when no vapor or gas is being detected and the second signal when a vapor or gas is detected. The system 30 is designed, in combination with the detector 12, to provide an accurate and expeditious method for detecting and alerting personnel that there are toxic gases and/or vapors within a specific detection area.

Figure 1:
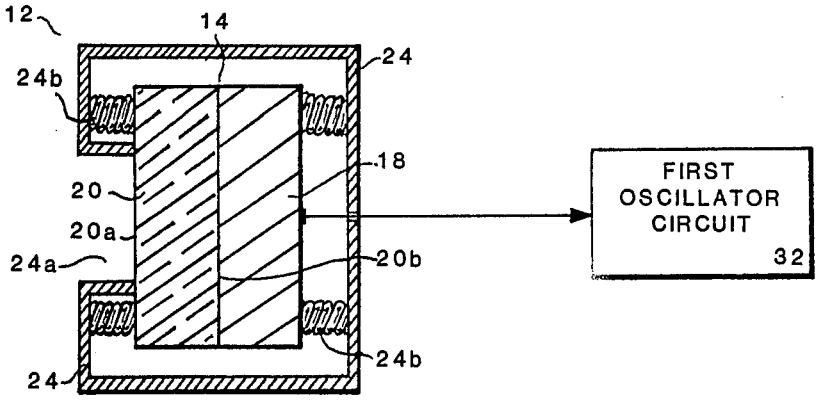
FIG. 1 is a cross-sectional view of a vapor or gas detector incorporating a two-section dynamic junction.

The first embodiment of the vapor and gas detector 12 is configured as a two-section dynamic junction 14, as shown in FIG. 1, that is comprised of two major components: a resonant mechanical element 18 and an absorbate 20.

The absorbate has a front 20*a* that is exposed to the outside environment and a back 20*b* to where the element 18 is rigidly and directly attached. The absorbate is designed to attract and adsorb the vapor or gas molecules in proportion to their molecular density, molecular size and exposure time. When no vapor or gas is being absorbed by the absorbate, the element is under a no-strain, no-deformation condition and under this condition, it emits a first frequency signal. When a vapor or gas is absorbed, a pressure differential is created between the element 18 and the absorbate. This pressure differential causes the element to strain and deform and emit a second frequency signal that differs from the first frequency signal. Either the first or second frequency signals is applied to a first oscillator circuit 32 in the system 30 described infra.

Figure 2:
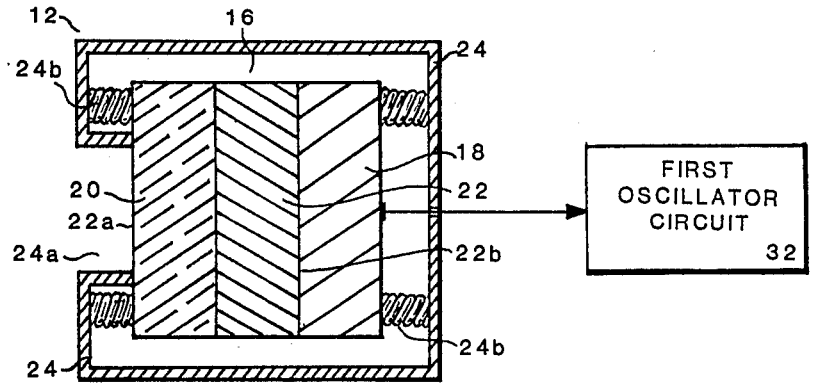
FIG. 2 is a cross-sectional view of a vapor or gas detector incorporating a three-section dynamic junction.

The three-section dynamic junction 16, as shown in FIG. 2, is comprised of three major components: an element 18, an absorbate 20 and a resilient substrate 22. The substrate allows a greater detector yield by having the absorbate initially attached to its front surface rather than to the more fragile element 18. The substrate, with the absorbate, is then easily attached to the element. The substrate may be made from natural or synthetic rubber, vinyl, polyethylene or a combination of materials. The only requirement imposed, is that it be resilient and have a surface that allows the absorbate and the resonant mechanical element to be attached. The resilient substrate 22 has a front and a back 22*b*. Rigidly attached to the substrate's front is the absorbate 20. The absorbate, as in the first embodiment, is exposed to the environment and attracts and adsorbs vapor or gas molecules in proportion to their molecular density, molecular size and exposure time. When no vapor or gas is being absorbed by the absorbate the element is not strained or deformed and emits a first frequency signal. When a vapor or gas is detected and absorbed by the absorbate the resilient substrate 22 deforms which, in turn, causes the element to strain and deform and thus emit a second frequency signal that differs from the first frequency signal.

The resonant mechanical element 18, as used with either the two or three section dynamic junctions may be comprised of various substances with a quartz crystal being the preferred element because of its frequency stability over a wide temperature range. An electroceramic material, such as barrium titanate, may also be used in those cases where lower cost is important or for disposable applications.

The absorbate material selected is dependent upon the vapor or gas that is to be detected. In situations where a specific vapor or gas is known to exist, an absorbate that is known to be sensitive to that specific vapor or gas is obviously selected. In cases where one or more vapors or gases or a family of vapors or gases are to be detected, absorbate sensitive to the generic vapor or gas family is selected. If in the detection area, it is known that a quantity of different vapors or gases or family of vapor and gas exit, an absorbate with maximum sensitivity is selected. By experimentation, it was discovered that the following absorbate materials had sufficient absorbing sensitivity and power to change the physical characteristics of the substrate 22 or the crystal directly to cause the crystal to deform sufficiently to produce a frequency change:

| ABSORBATE MATERIAL | VAPOR OR GAS SENSITIVITY |
|---|---|
| Activated Charcoal | High and low molecular Hydrocarbons and Halogenated compounds such as PCB and Methylbromode |
| Silica | Low Molecular Hydrocarbons |
| Ion Exchange Materials | Toxic Ion Metals such as Mercury, Chrome, and Cadmium |

In their preferred embodiment, the two or three dynamic junctions 14 or 16 is mounted within an enclosure 24 as shown in FIGS. 1 and 2. The enclosure is comprised of a mounting structure that includes an opening 24*a* and a set of shock mounts 24*b*. The opening is sized to allow the absorbate to be exposed to the outside environment. The shock mounts allow the entire two or three section dynamic junction 12, 14 to be mounted in a preloaded condition so that the element 18 is not strained or deformed by external physical forces.

As previously mentioned, the vapor or gas detector 12, in either the two or three section dynamic junction configurations 14 or 16, may be used with the vapor or gas detecting and alarm system 30. In the discussion that follows, only the three section configuration of the detector is covered.

Figure 3:
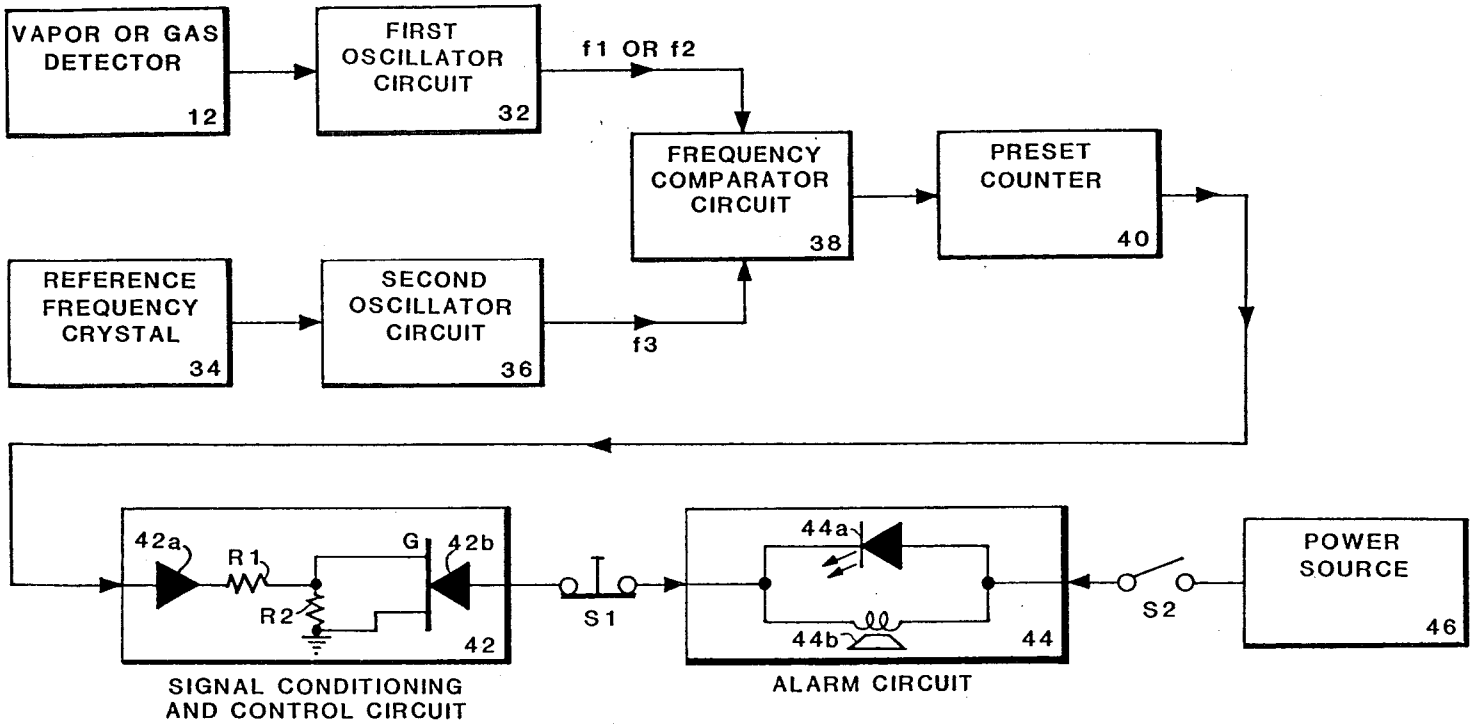
FIG. 3 is a block and schematic diagram of the vapor or gas detector installed in the vapor or gas detecting and alarm system.

The system 30, as shown in FIG. 3, is comprised of twelve major elements: the detector 12, a first oscillator circuit 32, a reference frequency crystal 34, a second oscillator circuit 36, a frequency comparator circuit 38, a preset counter circuit 40, a signal conditioning and control circuit 32, an alarm circuit 44, a power source 46, an enclosure 48 and an SCR reset switch S1 and a power switch S2.

The vapor and gas detector 12 is designed to operate in combination with the system 30 to control the frequency of the first oscillator circuit 32. When the absorbate 20 is exposed to a "clean" environment, that is, an environment free from significant amounts of contaminants and pollution, the absorbate produces no strain or stress to the resilient substrate 22 which, in turn, allows the element 18 to also remain in a no-stress quiescent condition. In its quiescent state, the element produces the first frequency signal that drives and allows the first oscillator 32 to oscillate and emit a first frequency oscillator signal f1.

When the absorbate 20 is exposed to an environment having contaminants, such as a hydrocarbon, it attracts and absorbs the vapor or gas which, in turn, creates the pressure differential between the resonant mechanical element 18 and the substrate 22. This pressure differential causes the element to deform and emit the second frequency signal. Thus, the absorbed vapor or gas is translated into a frequency change which is proportional to the vapor or gas concentration absorbed. The second frequency signal drives and allows the first oscillator 32 to oscillate and emit a second frequency oscillator signal f2.

The vapor and gas detector 12 and the first oscillator circuit 32 operate in combination with a reference path consisting of the reference frequency crystal 34 and the second oscillator circuit 34 as shown in FIG. 3. A reference path is desirable because it provides thermal stabilization between the detector 12 and the reference frequency crystal 34 which, in turn, allows a zero offset (common reference) for their respective outputs. The stabilization also compensates for the aging affects of the crystal and other components and allows the system 30 to be located in areas exhibiting a wide fluctuations in temperatures. The reference crystal 34 emits reference signal that has a frequency identical to the first frequency signal emitted by the detector 12. The reference frequency drives and controls the frequency of the second oscillator circuit 36 allowing this second oscillator to emit a reference frequency oscillator signal f3. Thus, when the frequency of the signal f3 is identical to the first frequency oscillator signal f1, the vapor and gas detector 12 is not detecting a contaminant. Conversely, when the second frequency oscillator signal f2 is emitted by the first oscillator circuit 32, the difference in the two frequencies indicates the presence of a toxic vapor or gas.

The f1 or f2 signals from the first oscillator circuit 32 and the f3 signal from the second oscillator circuit 36 are applied to the frequency comparator circuit 38.

The frequency comparator circuit 38 is adjusted to produce a vapor/gas signal when a preset alarm level is attained. This alarm level is set in accordance with established standards regulated by an appropriate Government agency or by other standards set by the using company. Under normal conditions (vapor or gas levels below alarm levels) the comparator signal is too narrow to activate the preset counter circuit 40.

The preset counter circuit 40 is designed to be activated and produce a trigger signal when three consecutive vapor/gas signals are received from the comparator 38. Under normal conditions, noise may cause a single comparator signal to occur and be sent to the counter. However, if this first count is not consecutively followed by a second and third count within a preset period, usually two to three seconds, the counter will automatically reset. By requiring that three counts appear within a specified time, most false alarms are eliminated.

When a vapor or gas is detected and the comparator 38 reaches the required alarm level and three counts are received by the counter 40, the counter will produce the trigger signal.

The trigger signal is applied to the signal conditioning and control circuit 42. The signal is applied through an amplifier 42*a* and resistor R1 to the gate lead G of an SCR 42*b*. The resistor R1 functions as a current limiter and also eliminates spurious noise signals that could inadvertently latch and turn on the SCR.

The SCR 42*b* has its cathode, together with a pull-down resistor R2, connected to circuit ground and its anode connected through a normally closed SCR reset switch S1 to one side of the alarm circuit 44. The other side of the alarm circuit is connected through a power switch 52. When the SCR 42*b* is latched (turned on) by the application of the trigger signal, the alarm circuit 44 is energized by the power source 46. Once the system 10 is activated, it can only be deactivated by momentarily pressing on the SCR reset switch S1. The alarm circuit, as shown in FIG. 3 consists of a LED lamp 44*a* in parallel with an audible alarm 44*b*.

The power source 46 for the system 30 is preferably a rechargeable d-c battery such as a lithium battery. Alternatively, for more permanent installation, the power source 46 may be comprised of a conventional regulated d-c power supply that operates from utility power. The power supply may include a rechargeble battery that is maintained by an internal battery charging circuit. The battery would power the system 30 in the event of a utility power failure.

Figure 4:
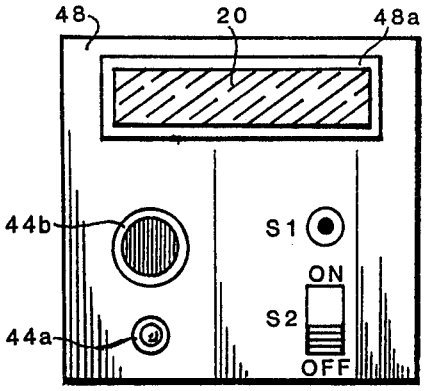
FIG. 4 is a front view of a typical portable enclosure containing the vapor or gas detector and the vapor or gas detecting and alarm system.
Figure 5:
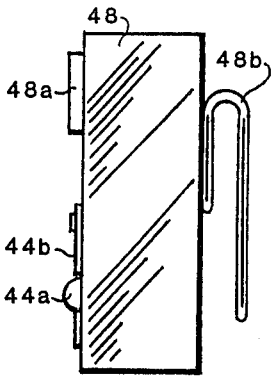
FIG. 5 is a side view of the portable enclosure.

The system 30 is designed to be attached either permanently or temporarily to most vapor or gas containment structures or it may be portable and carried or attached to a personal piece of clothing or a hard hat. A typical enclosure 48 for the portable configuration is shown in FIGS. 4 and 5. The portable enclosure 48 is designed with a window 48*a* that allows the vapor and gas detector 12 to be mounted with the absorbate 20 against the window allowing the absorbate to be exposed to the outside environment. On the front of the assembly is located the visual alarm 44*a* and the audio alarm 44*b* as well as the SCR reset switch S1 and the power switch S2. On the back of the enclosure is located a battery compartment (not shown) and a clip 48*b* that is suitable for engaging the enclosure 48 to a part of a structure, garment or hat. Alternatively, the entire system 30 may be designed as an integrated monolithic or hybrid microcircuit. In either of these design technologies, the absorbate 20 hermetically projects through the surface of the microcircuit package to the outside environment and the back of the microcircuit package can include an attachment means.

While the invention has been described in complete detail and pictorially shown in the accompanying drawings it is not to be limited to such details since many changes and modifications may be made to the invention without departing from the spirit and the scope thereof. For example, in an analog system a wheatstone bridge circuit could be used in lieu of the oscillator circuits. In this case, the bridge would produce a signal that is proportional to the concentration of the gas being measured. The bridge output would be converted to a digital signal by an analog-to-digital converter and routed as previously described. Additionally, the vapor or gas detector 12 and the reference frequency crystal 34 could be integrated into a single chip that also includes the first and second oscillator circuits 32, 36. In this integrated design, the quiescent oscillator frequency changes only when the element 18 in the detector causes a frequency change. Also, if a super stable vapor and gas detector 12 is used, it is possible to eliminate the reference frequency crystal 34. Hence, it is described to cover any and all modifications and forms which may come within the language and scope of the claims.

What is claimed is:

1. A vapor or gas detector having the means to produce a first frequency signal or a second frequency signal, where the first signal is emitted when no vapor or gas is being detected and where the second signal is emitted when a vapor or gas is detected, where said detector is comprised of a three-section dynamic junction further comprising:

(a) a resilient substrate having a front and a back, (b) a resonant mechanical element rigidly attached to the back of said substrate, and (c) an absorbate rigidly attached to the front of said substrate, where said absorbate is exposed to the outside environment and is designed to attract and adsorb the vapor or gas molecules in proportion to their molecular density, molecular size and exposure time where:

(1) when no vapor or gas is being absorbed by said absorbate said element is under a no-strain, no-deformation condition and thus emits a first frequency signal, and, (2) when a vapor or gas is absorbed by said absorbate a pressure differential is created between said element and said substrate that causes said element to strain and deform and thus emit a second frequency signal that differs from the first frequency signal.

2. A vapor or gas detector having the means to produce a first frequency signal or a second frequency signal, where the first signal is emitted when no vapor or gas is being detected and where the second signal is emitted when a vapor or gas is detected, where said detector is comprised of a three-section dynamic junction further comprising:

(a) a resilient substrate having a front and a back, (b) a crystal rigidly attached to the back of said substrate, and (c) an absorbate rigidly attached to the front of said substrate, where said absorbate is exposed to the outside environment and is designed to attract and adsorb the vapor or gas molecules in proportion to their molecular density, molecular size and exposure time where:

(1) when no vapor or gas is being absorbed by said absorbate said element is under a no-strain, no deformation condition and thus emits a first frequency signal, and (2) when a vapor or gas is absorbed by said absorbate a pressure differential is created between said element and said substrate that causes said element to strain and deform and thus emit a second frequency signal that differs from the first frequency signal.

3. A vapor or gas detector having the means to produce a first frequency signal or a second frequency signal, where the first signal is emitted when no vapor or gas is being detector and where the second signal is emitted when a vapor or gas is detected, where said detector is comprised of a three-section dynamic junction further comprising:

(a) a resilient substrate having a front and a back, (b) a quartz crystal rigidly attached to the back of said substrate, and (c) an absorbate rigidly attached to the front of said substrate, where said absorbate is exposed to the outside environment and is designed to attract and absorb the vapor or gas molecules in proportion to their molecular density, molecular size and exposure time where:

(1) when no vapor or gas is being absorbed by said absorbate said element is under a no-strain, no-deformation condition and thus emits a first frequency signal, and (2) when a vapor or gas is absorbed by said absorbate a pressure differential is created between said element and said substrate that causes said element to strain and deform and thus emit a second frequency signal that differs from the first frequency signal.

4. A vapor or gas detector having the means to produce a first frequency signal or a second frequency signal, where the first signal is emitted when no vapor or gas is being detected and where the second signal is emitted when a vapor or gas is detected, where said detector is comprised of a three-section dynamic junction further comprising:

(a) a resilient substrate having a front and a back, (b) an electroceramic material rigidly attached to the back of said substrate, and (c) an absorbate rigidly attached to the front of said substrate, where said absorbate is exposed to the outside environment and is designed to attract and adsorb the vapor or gas molecules in proportion to their molecular density, molecular size and exposure time where:

(1) when no vapor or gas is being absorbed by said absorbate said element is under a no-strain, no deformation condition and thus emits a first frequency signal, and (2) when a vapor or gas is absorbed by said absorbate a pressure differential is created between said element and said substrate that causes said element to strain and deform and thus emit a second frequency signal that differs from the first frequency signal.

5. A vapor or gas detector comprised of a three-section dynamic junction further comprising:

(a) a resilient substrate having a front and a back, (b) a resonant mechanical element rigidly attached to the back of said substrate, and (c) an absorbate consisting of an activated charcoal rigidly attached to the front of said substrate, where said absorbate is exposed to the outside environment and is designed to attract and absorb the vapor or gas molecules in proportion to their molecular density, molecular size and exposure time where:

(1) when no vapor or gas is being absorbed by said absorbate said element is under a no-strain, no deformation condition and thus emits a first frequency signal, and (2) when a vapor or gas is absorbed by said absorbate a pressure differential is created between said element and said substrate that causes said element to strain and deform and thus emit a second frequency signal that differs from the first frequency signal.

6. A vapor or gas detector wherein said detector is comprised of a three-section dynamic junction further comprising:

(a) a resilient substrate having a front and a back, (b) a resonant mechanical element rigidly attached to the back of said substrate and mounted within an enclosure in a preloaded condition so that said resonant mechanical element is not strained or deformed by external physical forces, and (c) an absorbate rigidly attached to the front of said substrate, where said absorbate is exposed to the outside environment and is designed to attract and adsorb the vapor or gas molecules in proportion to their molecular density, molecular size and exposure time where:

(1) when no vapor or gas is being absorbed by said absorbate said element is under a no-strain, no deformation condition and thus emits a first frequency signal, and (2) when a vapor or gas is absorbed by said absorbate a pressure differential is created between said element and said substrate that causes said element to strain and deform and thus emit a second frequency signal that differs from the first frequency signal.

7. A vapor or gas detector wherein said detector is comprised of a three-section dynamic junction and is also comprised of an element of a vapor or gas detecting and alarm system where said three-section dynamic junction further comprises:

(a) a resilient substrate having a front and a back, (b) a resonant mechanical element rigidly attached to the back of said substrate, and (c) an absorbate rigidly attached to the front of said substrate, where said absorbate is exposed to the outside environment and is designed to attract and adsorb the vapor or gas molecules in proportion to their molecular density, molecular size and exposure time where:

(1) when no vapor or gas is being absorbed by said absorbate said element is under a no-strain, no-deformation condition and thus emits a first frequency signal, and, (2) when a vapor or gas is absorbed by said absorbate a pressure differential is created between said element and said substrate that causes said element to strain and deform and thus emit a second frequency signal that differs from the first frequency signal, and where said element of a vapor or gas detecting and alarm system further comprises:

(d) a first oscillator circuit that oscillates at and emits a first frequency oscillator signal (f1) when the first frequency signal from said detector is applied and which changes and emits a second frequency oscillator signal (f2) when the second frequency signal from said detector is applied, (e) a reference frequency crystal that emits a reference frequency signal, (f) a second oscillator circuit that oscillates and emits a reference frequency oscillator signal (f3) when the reference frequency signal from said reference crystal is applied, (g) a frequency comparator circuit that receives the first frequency oscillator signal (f1) or second frequency oscillator signal (f2) from said oscillator and the reference frequency oscillator signal (f3) from said second oscillator circuit, where said comparator emits a vapor/gas signal when said second frequency oscillator signal (f2) exceeds a preset signal level, (h) a preset counter circuit connected to the output of said comparator circuit where said counter emits a trigger signal when the applied vapor/gas signal from said comparator exceeds a preset count within a specified time period, (i) an alarm circuit that is energized upon the application of the trigger signal from said counter, and (j) a power source designed to provide all the voltages and currents required to operate said system.

8. A vapor or gas detector wherein said detector comprises an element of a vapor or gas detecting and alarm system further comprising:

(a) a first oscillator circuit that oscillates at and emits a first frequency oscillator signal (f1) when the first frequency signal from said detector is applied and which changes and emits a second frequency oscillator signal (f2) when the second frequency signal from said detector is applied, (b) a reference frequency crystal that emits a reference frequency signal, (c) a second oscillator circuit that oscillates and emits a reference frequency oscillator signal (f3) when the reference frequency signal from said reference crystal is applied, (d) a frequency comparator circuit that receives the first frequency oscillator signal (f1) or second frequency oscillator signal (f2) from said oscillator and the reference frequency oscillator signal (f3)

from said second oscillator circuit, where said comparator emits a vapor/gas signal when said second frequency oscillator signal (f2) exceeds a preset signal level, (e) a preset counter circuit connected to the output of said comparator circuit where said counter emits a trigger signal when the applied vapor/gas signal from said comparator exceeds a preset count within a specified time period, (f) an alarm circuit that is energized upon the application of the trigger signal from said counter wherein said alarm circuit comprises a signal conditioning and control circuit located in series between said preset counter circuit and said alarm circuit where said signal conditioning and control circuit comprises:

(1) an amplifier that receives and amplifies the trigger signal from said counter, and (2) an SCR having its gate lead connected to the trigger signal from said amplifier, its cathode connected to circuit ground and its anode connected through an SCR reset switch to one side of said alarm circuit where other side of said alarm circuit is connected to said power source, where upon the application of the trigger signal, the SCR turns on, allowing the power from said power source to energize said alarm circuit and, (g) a power source designed to provide all the voltages and currents required to operate said system.

9. A vapor or gas detects wherein said detector comprises an element of a vapor or gas detecting and alarm system that is constructed as an integrated microcircuit wherein an absorbate on said vapor and gas detector projects through the surface of the microcircuit package to allow said absorbate to be exposed to the outside environment where said detector is comprised of a three-section dynamic junction further comprising:

(a) a resilient substrate having a front and a back, (b) a resonant mechanical element rigidly attached to the back of said substrate, and (c) said absorbate rigidly attached to the front of said substrate, where said absorbate is designed to attract and adsorb the vapor or gas molecules in proportion to their molecular density, molecular size and exposure time where:

(1) when no vapor or gas is being absorbed by said absorbate said element is under a no-strain, no-deformation condition and thus emits a first frequency signal, and (2) when a vapor or gas is absorbed by said absorbate a pressure differential is created between said element and said substrate that causes said element to strain and deform and thus emit a second frequency signal that differs from the first frequency signal, and where said vapor or gas detecting and alarm system further comprises:

(a) a first oscillator circuit that oscillates at and emits a first frequency oscillator signal (f1) when the first frequency signal from said detector is applied and which changes and emits a second frequency oscillator signal (f2) when the second frequency signal from said detector is applied, (b) a reference frequency crystal that emits a reference frequency signal, (c) a second oscillator circuit that oscillates and emits a reference frequency oscillator signal (f3) when the reference frequency signal from said reference crystal is applied, (d) a frequency comparator circuit that receives the first frequency oscillator signal (f1) or second frequency oscillator signal (f2) from said oscillator and the reference frequency oscillator signal (f3) from said second oscillator circuit, where said comparator emits a vapor/gas signal when said second frequency oscillator signal (f2) exceeds a preset signal level, (e) a preset counter circuit connected to the output of said comparator circuit where said counter emits a trigger signal when the applied vapor/gas signal from said comparator exceeds a preset count within a specified time period, (f) an alarm circuit that is energized upon the application of the trigger signal from said counter, and (g) a power source designed to provide all the voltages and currents required to operate said system.

* * * * *